United States Patent [19]

Naarding et al.

[11] 4,025,989

[45] May 31, 1977

[54] OPENING AND CLEANING MACHINE FOR FIBROUS MATERIAL, ESPECIALLY COTTON

[75] Inventors: Bill J. Naarding, Hengelo, Netherlands; Herbert Hergeth, Dulmen, Germany

[73] Assignee: Hergeth KG Maschinenfabrik und Apparatebau, Dulmen, Germany

[22] Filed: Dec. 30, 1975

[21] Appl. No.: 645,402

[30] Foreign Application Priority Data

Apr. 11, 1975 Germany ..... 2515780
Sept. 17, 1975 Germany ..... 2541380

[52] U.S. Cl. ..... 19/93; 19/200
[51] Int. Cl.² ..... D02J 7/00
[58] Field of Search ..... 19/35, 36, 37, 38, 90, 19/91, 93, 85; 209/135, 136, 137, 12, 24, 27

[56] References Cited

UNITED STATES PATENTS

| | | | |
|---|---|---|---|
| 1,058,846 | 4/1913 | Conrad | 19/38 |
| 1,209,114 | 12/1916 | Cass | 19/93 |
| 1,303,160 | 5/1919 | Brune et al. | 19/37 |
| 1,397,257 | 11/1921 | Stacy | 19/38 |
| 2,421,483 | 6/1947 | Deems et al. | 19/93 |
| 2,844,847 | 7/1958 | Smith | 19/93 X |
| 2,943,360 | 7/1960 | Hergeth et al. | 19/93 |

*Primary Examiner*—Dorsey Newton
*Attorney, Agent, or Firm*—Diller, Brown, Ramik & Wight

[57] ABSTRACT

This disclosure relates to an opening and cleaning machine for fibrous material, including a plurality of rotatable beaters disposed within a housing, grating means adjacent to and beneath the beater units, guide plate meansgenerally adjacent to and above the beater units, first and second aperture means respectively adjacent first and last of the beater units through which fibrous material is respectively fed into and removed from the machine, and third aperture means in a top wall of the housing through which suction can be drawn to remove dust during the processing of the fibrous material.

9 Claims, 2 Drawing Figures

OPENING AND CLEANING MACHINE FOR FIBROUS MATERIAL, ESPECIALLY COTTON

The present invention is directed to a novel opening and cleaning machine for fibrous material, particularly cotton.

In a conventional open end spinning process fine dust contained in the cotton is known to lead to fouling of the recess of the rotary spinning chamber. In another conventional machine such dust fouls the perforated ring so that after a few hours of operation, the deposits in the rotary chamber and the like reach such a degree that yarn quality is impaired and yarn breakage occurs. Extensive dust removal is, therefore, a precondition for the efficient operation of an open end spinning process.

The opening and cleaning of cotton fibers is known to be done in different ways. On one hand, the fibers are opened in an entangled condition while on the other hand, the fibers can be opened when carried by an airstream with further opening of the flakes occurring in a freely suspended condition. In these opening processes, some degree of cleaning of the fibrous material is also carried out. This cleaning does not, however, meet the requirements necessary for open end spinning processes. In particular, the fibrous material still contains too much fine dust which impairs uninterrupted operation of the open end spinning machines. Special machines have, therefore, been developed to remove dust from cotton as, for example, special condensers which follow in line behind the opening machine and remove dust by suction through a screen drum. Since this entails the location of two machines in sequence, there is a resultant loss of floor space and some type of transfer device is necessary for transferring the fibrous material from the opening machine to the dust removal machine. This obviously is an extra cost factor.

In accordance with the present invention the machine not only opens the cotton or like fibrous material but any dust is efficiently removed at the same time so that additional dust removal procedures or separate dust removal machines are eliminated. Underlying the invention is the recognition that of the three known methods of cotton opening and cleaning effective dust removal from the fibrous material, including the removal of microfine dust, can only be achieved during the opening of the fibers while in a freely suspended condition.

In accordance with the present invention there is provided an opening and cleaning machine in which double rotary beater units are located one behind the other in a horizontal or inclined row with cooperating gratings and guide plates, respectively, beneath and above the beater units and means are provided to draw a suction in a space above the guide plates to draw dust from the fibrous material during its processing between a charging hopper and a discharge outlet.

The last-mentioned design of an inclined or stepwise cleaner makes it possible to meet the increased requirements of dust removal by doing so during the opening of the fibers in a freely suspended state and, of course, in a single machine. The fibrous material is beaten from the bottom upwardly in a freely suspended state by the fast-rotating beater units and the fibrous material is cleaned over the gratings so that a large amount of dust is released. In this case, the duration time of the freely-suspended fibers in the zone of the beater units may be influenced by guide plates and or adjustable cutters.

When the casing or housing surrounding the beater units is sufficiently high in design so that a relatively high free space results above the beater units, the dust released by the inclined upward beating or thrushing if the fibers moves upwards turbulently in such a way that the dust can be most efficiently drawn or removed by suction. Furthermore, by arranging the suction outlet at a corresponding distance from the beater units, the freely-suspended fibers do not pass into the region or space of accelerated air flow but simply fall back into the beater units. On the other hand, the released dust, especially microfine dust, passes into the suction region or zone and in this way a large percentage of the dust released from the fibrous material is reliably removed from the machine. Thus, opening, cleaning and dust removal from the cotton or other fibrous material are effected at one and the same time and the risk of fibers also being removed by suction is eliminated.

The separation of the dust from the fibers is effected when the latter are in a freely suspended space without the necessity for mechanical separating means, such as screen plates, screen drums or the like. At the same time, it is insured that the removal of dust, especially microfine dust, is carried out during a condition of the fibers in which the dust removal is at its most effective, namely, during free suspension of the fibers during their opening and cleaning. The suction effect covered the entire freely-suspended region of the fibers in the machine from inlet to outlet. In this way, opening, cleaning and dust removal are efected in one single machine with the maximum degree of efficiency for all three procedures. A further result is that the dust removal by suction gives rise to a low-pressure area above the beater units which means that an air flow directed against the flight of the fibers at the outlet of the housing holds back the dust. In this way, the released dust does not emerge from the housing at the outlet end thereof and cannot pass into the open air.

When the rotating beater units are inclined, the arrangement is advantageously such that the top or cover wall of the housing is level or horizontal and is disposed at a height above the last and highest beater unit. In this way a great deal of free space is provided in the housing above the beater units with the greatest height of this region being at the inlet opening and progressively reducing in height toward the outlet. In this case the suction removal outlet is, therefore, advantageously located adjacent the front or inlet end of the housing with the suction removal flow being more or less opposite in direction to the movement of the fibers conveyed by the beater units towards the discharge end of the housing.

In order to allow the released dust to escape freely upwardly under the influence of the suction effect, the guide plates are provided with apertures and are preferably spaced from each other so that a space exists between adjacent guide plates through which the dust can be drawn in an upward fashion.

The suction removal of dust is considerably intensified when the guide plates are provided with perforations. Such perforations in the guide plates enable the released dust, particularly microfine dust, to pass in a less hindered fashion into the suction region or area above the beater units. The dust removal from the fibrous material subjected to the beater units reaches such a high degree on the stepwise or inclined cleaner that the cleaned fibrous material can safely and surely comply with the high requirements for dust-free purity in an open end spinning process.

The apertures in the guide plates may be round or elongated or may be designed with partial recesses or may be in the form of nozzles. However, because the guide plates are located above the beater unit, the flow of fibers is so directed that the fibers as far as possible remain within the region of the beater units and only the dust is exhausted by suction. At the same time the air flow in the upper portion of the housing assures that the fibers cannot come to rest on the guide plates or on cross braces in the machine although the latter are also preferably perforated. The guide plates enable excellent control of the flight of the fibers in a simple manner in the desired manner.

The outlet of the machine includes a canopy in the region of the last beater unit and a baffle plate is located adjacent thereto. In this way, the air space provided for suction removal at the outlet end is more or less enclosed resulting in an emergence of the dust at the outlet end.

With the above and other objects in view that will hereinafter appear, the nature of the invention will be more clearly understood by reference to the following detailed description, the appended claims and the several views illustrated in the accompanying drawings:

Figures 1, 2:
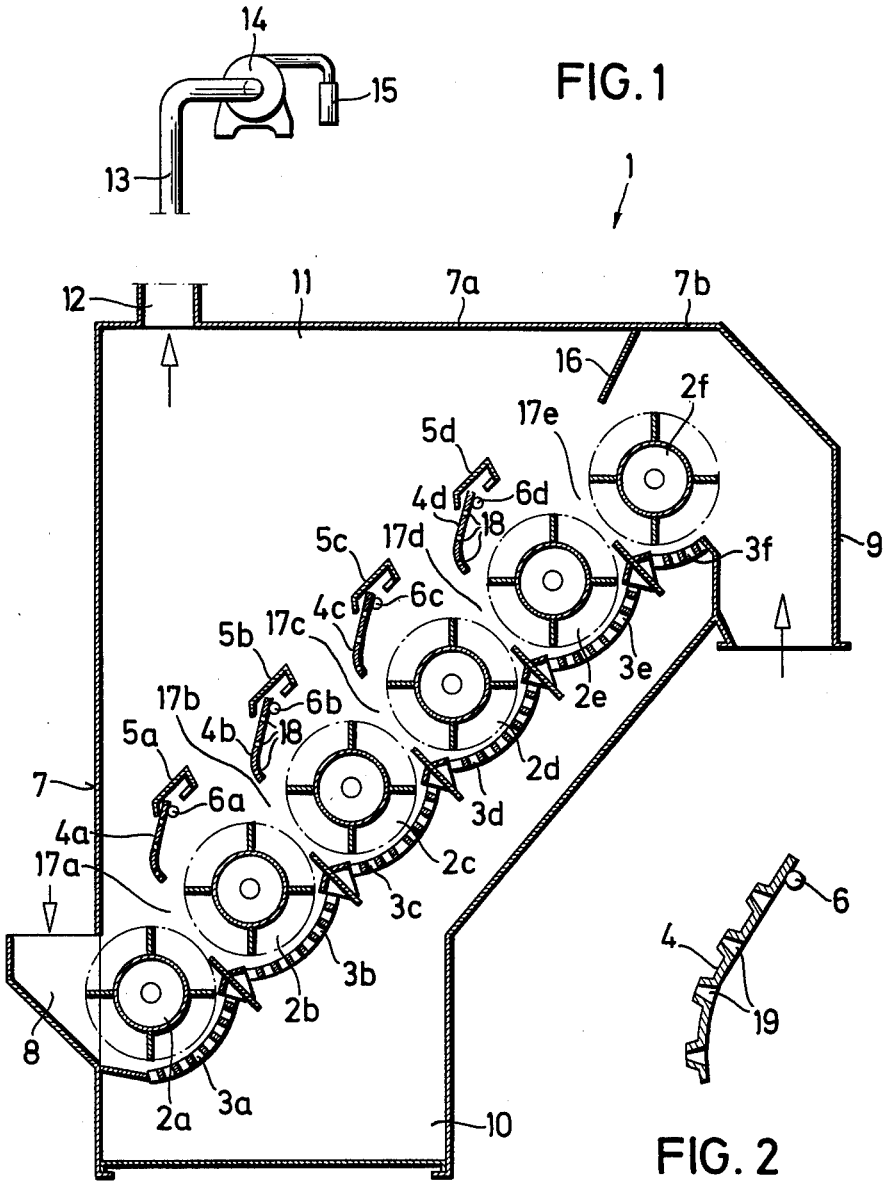
FIG. 1 is a vertical cross sectional view of the novel machine of this invention, and illustrates a plurality of inclined or step-wise position beater units with a suction area or region thereabove coupled by a conduit to suction or vacuum creating means.
FIG. 2 is an enlarged cross-sectional view of a modified guide plate, and illustrates perforations thereof in the form of nozzles.

A novel opening and cleaning machine for cotton or like fibrous material is generally designated by the reference numeral 1 and includes double rotating beater units 2*a* through 2*f* located one above another in an inclined or step-wise row with a gap (unnumbered) between adjacent pairs of beater units as, for example, between the beater units 2*a*, 2*b*, 2*b* 2*c*; etc.; A plurality of grating means or gratings 3*a* through 3*f* which may be rod gratings are disposed beneath and adjacent to the respective beater units 2*a* through 2*f*. A plurality of spaced guide plates 4*a* through 4*d* are located above the beater units 2*b* through 2*e*. The guide plates 4*a* through 4*d* are disposed at an angle and the angle is adjusted as desired. A plurality of cross members 5*a* through 5*d* span the interior of the housing and support the respective guide plates 4*a* through 4*d* by respective pivot pins or rods 6*a* through 6*d*.

The beater units, gratings and guide plates just described are housed within a casing or housing 7 which adjacent the first beater unit 2*a* includes an infeed hopper 8 while behind the last beater unit 2*f* the housing 7 has an outlet hood 9 through which the cleaned fibrous material is discharged.

Underneath the gratings 3*a* through 3*f* is a space 10 for receiving waste which drops through the gratings 3*a* through 3*f* during the processing of the fibrous material, namely, during the opening and cleaning thereof. Above the guide plates 4*a* through 4*d* and the cross members 5*a* through 5*d* the housing 7 encloses a free space or region 11 which is of considerable height and is at least that of the over-all height of the beater units. A generally horizontal top wall 7*a* covers this region and includes an aperture or opening 12 which is joined by a conduit 13 to a suction fan 14 having a conventional filter 15. The top wall 7*a* is essentially a portion or extension of a wall portion 7*b* which overlies the uppermost of the beater units 2*f*. Thus, the space 11 is generally of a triangular configuration, as viewed in cross section and this results in an over-all height of the space 11 which, with the exception of the space of the outlet hood 9, exceeds the height of the beater units to a considerable degree. The outlet hood 9 is defined at an inner side thereof by a baffle or guide plate 16.

Free spaces or gaps 17*a* through 17*e* are provided between the cross members 5*a* through 5*d* and the guide plates 4*a* through 4*d*. Each gap 17*a* through 17*e* is aligned with a gap (unnumbered) between the beater units 2*a* through 2*f* and the thus aligned gaps lie in a plane generally transverse to the grating means 3*a* through 3*f*. Preferably the guide plates 4*a* through 4*d* are perforated with the perforations 18 being of an optional cross sectional shape as, for example, round or elongated. The perforations may have an appreciable depth such as the perforations 19 of FIG. 2 which are of a nozzle-like shape. the perforations 18 or 19 of the guide plates 4*a* through 4*d* result in a considerable increase in the dust removed by suction. The dust occurring, inclusive of microfine dust, can pass in a little hindered fashion into the free space 11 and intensive dust removal is thus obtained.

It is further possible to provide the cross members 5*a* through 5*d* with corresponding apertures or perforations so that at these points the dust can readily rise through the perforations and pass the cross members when subject to the suction action within the area 11.

By the combination of an opening and cleaning machine in which the opening of the fibers is effected in a freely suspended state the provision of a free air space 11 in the closed housing 7 and the location of the suction removal through the outlet 12 at the front of the greatest height of the space 11 extremely efficient dust removal from the fibrous material is obtained. The dust is sucked out directly from the machine by the fan 14, although any other appropriate suction removal device may alternatively be provided. In the invention described, both coarse dust and also so-called microfine dust is to a high degree separated during the opening and cleaning process. The dust loosened and released from the flakes passes, as a result of the suction, in an upward direction, and the free intermediate spaces 17*a* through 17*e* contribute considerably to this effect. It is at the same time assured that the freely suspended fibers cannot pass into the region of air flow accelerated by the suction removal system or can fall back onto the beater units. the entry of air into the housing is ensured both by the inlet hopper 8 and by the outlet hood 9. At the same time, the latter has the result that the released dust cannot pass into the open air through the later openings.

The waste space 10 located under the gratings 3*a* through 3*f* and into which heavy dust particles separated by the gratings come to rest is not influenced by the dust suction removal device and since the waste space 10 is totally enclosed so that no air flow can rise the heavier dust cannot be drawn upwardly through the gratings 3*a* through 3*f*.

While preferred forms and arrangement of parts have been shown in illustrating the invention, it is to be clearly understood that various changes in details and arrangement of parts may be made without departing from the scope and spirit of this disclosure.

We claim:

1. An opening and cleaning machine for fibrous material comprising means defining a housing, a plurality of rotatable beater units disposed within said housing, said beater units being in spaced relationship to each other and defining gaps between each adjacent pair of beater units, grating means disposed generally adjacent to and beneath said beater units, guide plate means disposed generally adjacent to and above said beater units, said guide plate means being in spaced relationship to each other and defining gaps between each adjacent pair of guide plate means, first aperture means in said housing adjacent a first of said beater units through which fibrous material is introduced into said housing for processing, second aperture means in said housing adjacent a last of said beater units through which air is drawn into said housing and through which processed fibrous material is discharged from said housing, third aperture means in said housing opening into a space above said guide plate means, means for creating suction in said space through said third aperture means for removing dust from said fibrous material during the processing thereof and discharging the removed dust from said space through said third aperture means, said housing includes a generally horizontal top wall, said third aperture means is in said top wall, and said beater units are disposed in an inclined fashion between said first and second aperture means, and adjacent pairs of said guide plate means gaps and said beater unit gaps are generally in alignment in a plane generally transverse to said grating means whereby the suction created in said space draws dust from said fibrous material through said gap and generally upwardly between all adjacent pairs of said guide plate means.

2. The machine as defined in claim 1 wherein said third aperture means is located generally above said first beater unit.

3. The machine as defined in claim 1 including a plurality of apertures in said guide plate means.

4. The machine as defined in claim 1 including a plurality of apertures in said guide plate means, and said plurality of apertures are of a nozzle-like shape.

5. The machine as defined in claim 1 wherein said guide plate means are defined by a plurality of guide plates in spaced relationship to each other.

6. The machine as defined in claim 1 wherein said guide plate means are defined by a plurality of guide plates in spaced relationship to each other, and means for adjusting the position of said guide plates relative to said beater units.

7. The machine as defined in claim 1 wherein said guide plate means are defined by a plurality of guide plates in spaced relationship to each other, and a plurality of apertures in said guide plates.

8. The machine as defined in claim 1 including a baffle plate spanning said housing adjacent said last beater unit and said second aperture means.

9. The machine as defined in claim 1 including a plurality of cross members in said housing generally adjacent to and above said beater units, and a plurality of apertures in said cross members.

* * * * *